US007083346B2

(12) United States Patent
Jung et al.

(10) Patent No.: US 7,083,346 B2
(45) Date of Patent: Aug. 1, 2006

(54) PAPER DISCHARGE UNIT FOR AN INKJET PRINTER

(75) Inventors: Youn-gun Jung, Suwon (KR); Yong-duk Lee, Gunpo (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/695,352

(22) Filed: Oct. 29, 2003

(65) Prior Publication Data

US 2004/0141786 A1 Jul. 22, 2004

(30) Foreign Application Priority Data

Jan. 17, 2003 (KR) ..... 10-2003-0003429

(51) Int. Cl.
*B65H 29/70* (2006.01)
*B41J 2/01* (2006.01)

(52) U.S. Cl. ..... 400/642; 400/625; 347/104; 271/188

(58) Field of Classification Search ..... 400/578, 400/642, 625, 636, 637.2, 645, 645.3, 645.4, 400/624, 629, 639, 693, 637; 347/8, 104, 347/108; 271/207, 209, 161, 188
See application file for complete search history.

(56) References Cited

U.S. PATENT DOCUMENTS 5,820,282 A * 10/1998 Nakai ..... 400/642
6,634,745 B1 * 10/2003 Tanno ..... 347/107
6,669,191 B1 * 12/2003 Lee ..... 271/189
2002/0085078 A1 7/2002 Tanno ..... 347/104
2003/0006547 A1 1/2003 Lee ..... 271/189
2003/0057638 A1 * 3/2003 Nakamura ..... 271/264
2004/0100545 A1 * 5/2004 Kang ..... 347/104

FOREIGN PATENT DOCUMENTS

JP 63-165247 A * 7/1988
JP 05-124284 A * 5/1993
JP 10-245143 * 9/1998
JP 2003-160270 * 6/2003
JP 2003-326788 A * 11/2003

* cited by examiner

*Primary Examiner*—Leslie J. Evanisko
(74) *Attorney, Agent, or Firm*—Staas & Halsey LLP

(57) ABSTRACT

A paper discharge unit for an inkjet printer which ejects a sheet on which image printing is completed by an ink cartridge out of a printer main body. The paper discharge unit for an inkjet printer includes paper discharge rollers rotatably mounted in the printer main body to feed the printing-completed sheet out of the printer main body; and paper discharge guides disposed downstream of the paper discharge rollers in a direction the sheet is fed, and guiding upward the front end portion of the sheet ejected from the paper discharge rollers to prevent the rear end portion of the sheet from being lifted. Accordingly, the front end portion of the sheet is deformed by the paper discharge guides to restrain the end portion of the sheet facing a nozzle part of the ink cartridge from being in contact with the nozzle part when the sheet is ejected, so that image printing becomes possible up to the end portion of the sheet, to thereby improve the printing efficiency of the inkjet printer.

24 Claims, 9 Drawing Sheets

PAPER DISCHARGE UNIT FOR AN INKJET PRINTER

CROSS-REFERENCE TO RELATED APPLICATIONS

This application claims the benefit of Korean Application No. 2003-3429, filed Jan. 17, 2003, in the Korean Intellectual Property Office, the disclosure of which is incorporated herein by reference.

BACKGROUND OF THE INVENTION

1. Field of the Invention

The present invention relates to an inkjet printer, and more particularly to a paper discharge unit that ejects, out of a printer main body, sheets on which images are printed by an ink cartridge.

2. Description of the Related Art

FIG. 1 is a view for showing a conventional inkjet printer, in view of which the conventional inkjet printer 100 has a printer main body 110, an ink cartridge 130, a sheet pickup unit 140, a sheet feeding unit 150, and a paper cassette 120.

As the inkjet printer 100 having the above structure is driven, a sheet 10 of paper in the paper cassette 120 is fed under the ink cartridge 130 by a pickup roller 145 and first and second feeding rollers 151 and 153. Under this state, if the sheet 10 continues being fed by the second feeding roller 151 so that the sheet 10 comes off through the second feeding roller 151, the sheet 10 is conveyed out of the printer main body 100 by the paper discharge roller 161. At this time, the front end of the sheet 10 moving out of the printer main body 110 by the paper discharge roller 161 descends by its own weight.

As aforementioned, in case that the front end of the sheet 10 coming out of the printer main body 110 moves down by its own weight, a shape of the sheet 10 is entirely deformed due to sheet stiffness. Accordingly, the end portion E of the sheet 10 facing a nozzle part 135 of the ink cartridge 130 comes in contact with the nozzle part 135, so even a minimum interval necessary for image printing is not maintained between the end portion of the sheet 10 and the nozzle part 135.

Therefore, it becomes impossible to form images on the end portion E of the sheet 10 through ink firing, causing a problem that a printing amount printable on the sheet 10 is limited by the end portion E of the sheet 10.

SUMMARY OF THE INVENTION

Accordingly, an aspect of the present invention is to provide a paper discharge unit for an inkjet printer having an improved structure that prevents contact of the end portion of a sheet and the nozzle part of an ink cartridge so that image printing becomes possible up to the end portion of the sheet.

A paper discharge unit for an inkjet printer which ejects out of a printer main body a sheet of paper on which image printing is completed by a nozzle part, according to the present invention, comprises paper discharge rollers mounted in a printer main body to feed the image printing-completed sheet out of the printer main body; and a guide unit disposed downstream of the paper discharge rollers in a direction the sheet is fed, to guide the front end of the sheet upward just after ejection from the paper discharge rollers so that the rear end portion of the sheet is prevented from being lifted. Thus, the rear end portion of the sheet is restrained from coming in contact with a nozzle part of the ink cartridge.

Accordingly, the end portions of the sheet and the nozzle part of the ink cartridge are restrained from contacting of each other so that image printing becomes possible up to the end portion of the sheet, to thereby improve the printing efficiency of the inkjet printer.

According to a first embodiment of the present invention, the guide unit includes a guide member, that is, a paper discharge guide guiding the bottom face of the sheet when the sheet is ejected from the paper discharge rollers. The upper end portion of the paper discharge guide is formed to be placed higher than contact surfaces of the paper discharge rollers and the sheet.

A paper discharge opening is formed as a sheet-ejecting path on one side of the printer main body, and the guide member is disposed between the paper discharge rollers and the paper discharge opening.

According to a second embodiment of the present invention, the guide member is disposed adjacent to the paper discharge opening and protruded from an outer wall of the printer main body.

According to a third embodiment of the present invention, the guide unit includes at least one or more paper discharge guides elevatably mounted downstream of the paper discharge rollers in a direction the sheet is fed, and to guide the bottom face of the sheet ejected from the paper discharge rollers; and a driving unit to elevate the paper discharge guides in order for the upper end portions of the paper discharge guides to be disposed higher than a contact portion of the paper discharge rollers and the sheet as the sheet is discharged from the paper discharge rollers.

The driving unit preferably includes a support member to support the paper discharge guides; rotating members rotatably mounted on the printer main body, and to support the support member; and a rotating unit to rotate the rotating members in order for the paper discharge guides to ascend and descend in association with sheet feeding.

Further, the rotating unit preferably includes a first gear rotatably supported by a first rotation shaft member on one interior side of the printer main body and receiving a driving force from a certain driving element to rotate; and second gears mounted on a second rotation shaft member to rotatably support the rotating members on one interior side of the printer main body, and to rotate the rotating members in association with rotations of the first gear.

In case that the second gears are directly meshed with the first gear, preferably, the first gear alternately rotates forward and reverse corresponding to positions of the sheet as the sheet is fed, the second gears are formed in one body with the rotating members and formed with sector gears rotating by a certain rotation angle in association with the rotations of the first gear.

Further, the paper discharge rollers are mounted on the first rotation shaft member to rotate in association with the rotations of the first gear.

In an embodiment of the invention, in case that the second gears receive a driving force from the first gear by a certain power transmission unit, the first gear alternately rotates forward and in reverse corresponding to positions of the sheet as the sheet is fed, and the power transmission unit is a swing gear assembly interactably connecting the first gear and the second gears.

The swing gear assembly includes a pivot member rotatably mounted on the first rotation shaft member of the first gear; and third and fourth gears spaced from each other and rotatably mounted on the pivot member, and meshed with the first gear respectively, the pivot member rotating by the third and fourth gears meshed with the first gear as the first gear rotates, and the second gears selectively meshed with either of the third and fourth gears corresponding to rotations of the pivot member.

The second gears are sector gears rotating by a certain rotation angle in association with rotations of the first gear, and the third and fourth gears are multi-stepped gears each having a first gear part meshed with the first gear and a second gear part meshed with the second gear upon the rotations of the pivot member.

The second gears are mounted side by side in plural on a second rotation shaft member, and each of the second gears is selectively meshed with the third and fourth gears respectively as the pivot member rotates.

The second gears are formed in one body with the rotating members, and the paper discharge rollers are mounted on the first rotation shaft member to rotate in association with the rotations of the first gear.

The first gear is rotatably mounted upstream of the ink cartridge in the direction the sheet is fed, and connected through sheet feeding rollers supplying the sheet to the sheet discharge rollers and a certain gear train.

The driving unit further includes a guide protrusion protruded on one side of the support member opposite an internal wall of the printer main body, and a guide slit formed in the internal wall of the printer main body to guide rotations of the guide protrusion, a rotation range of the support member being limited by the guide protrusion and the guide slit.

Further, the driving unit further includes an elastic member that elastically presses the guide protrusion moved to either of both ends of the guide slit, to thereby restrain the guide protrusion from moving to the other end of the guide slit.

The elastic member is a toggle spring both ends of which are connected to the guide protrusion of the rotating member and the printer main body, and the toggle spring is formed in a one end-opened annular shape, and both ends of which are rotatably connected to the guide protrusion and the printer main body respectively.

Additional aspects and/or other advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
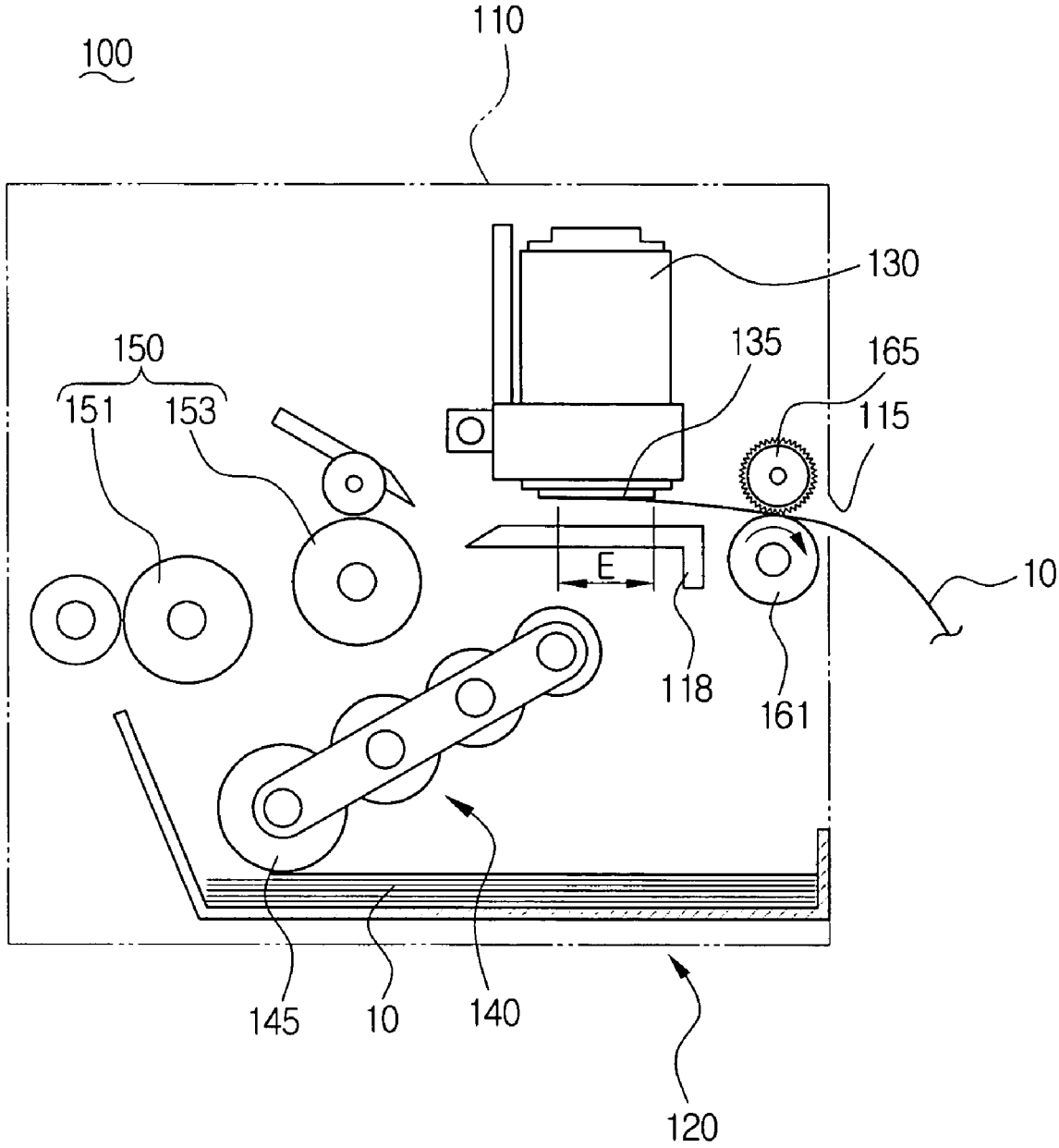
FIG. 1 (PRIOR ART)
FIG. 1 is a view for schematically showing an internal structure of a conventional inkjet printer.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
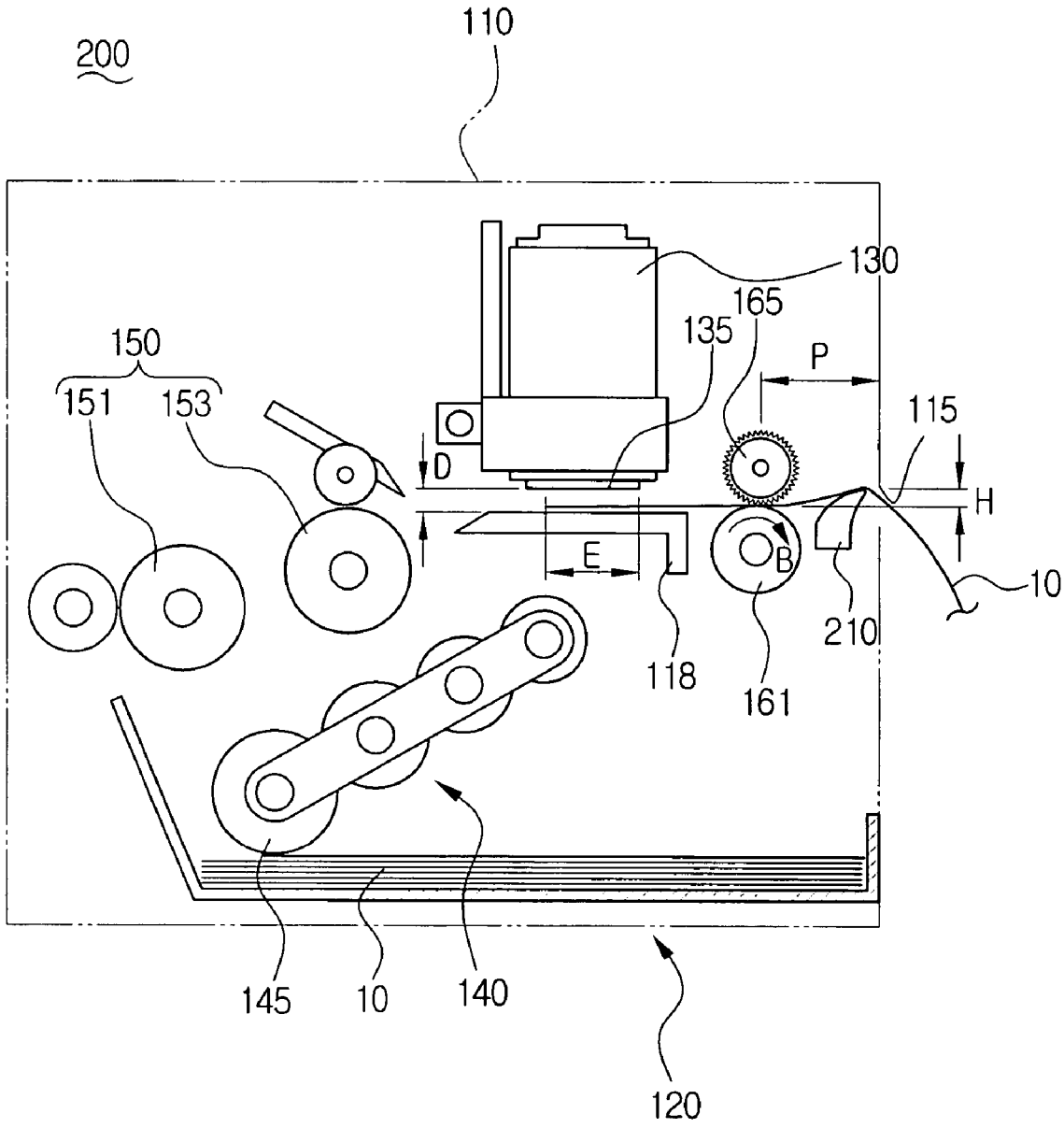
FIG. 2 is a view for schematically showing an internal structure of an inkjet printer according to a first embodiment of the present invention.

In FIG. 2, a paper discharge unit of an inkjet printer 200 according to the first preferred embodiment of the present invention includes paper discharge rollers 161, and a paper discharge guide 210 guiding the front end of the sheet 10 upward just after the front end of the sheet 10 comes out of the paper discharge rollers 161.

The paper discharge rollers 161 are mounted downstream of the ink cartridge 130 along a sheet-discharging direction, and receive a driving force of a driving unit to rotate forward and reverse. Hereinafter, the forward rotations of the paper discharge rollers 161 are referred to as the rotations in a direction to feed the sheet 10 out of the printer main body (not shown).

The paper discharge guide 210 is disposed downstream of the paper discharge rollers 161 in a sheet-feeding direction. The paper discharge guide 210 is formed in a shape so the end portion of the guide 210 is disposed higher than the contact position of the paper discharge rollers 161 and the idle rollers 165. Therefore, a certain height difference, that is, a certain interval H, is formed between a contact portion of the paper discharge rollers 161 coming in contact with the sheet 10 and the upper side, that is, the tip of the paper discharge guide 210. As shown in an embodiment of the present invention, where the paper discharge rollers 161 are mounted in a state that it is spaced in a certain interval from the paper discharge opening 115, preferably the paper discharge guide 210 is mounted on the paper discharge path P connecting the paper discharge rollers 161 with the paper discharge opening 115. If the paper discharge guide 210 as above satisfies a condition enabling the front end of the sheet 10 to be guided upward, it should be understood that the paper discharge guide 210 may be formed in diverse shapes rather than defined in the shape shown in the present embodiment.

With the above structure, the bottom face of the sheet 10 externally ejected out of the printer main body 110 by the paper discharge rollers 161 is guided upward by the paper discharge guide 210 at the downstream side of the paper discharge rollers 161 in the paper discharge direction, causing deformation of the sheet 10. Upon such deformation of the sheet 10, the end portion E of the sheet 10 descends down so that it is spaced in a certain distance D from the nozzle part 135 of the ink cartridge 130.

As stated above, where the paper discharge unit prevents the contact of the end portion E of the sheet 10 and the nozzle part 135 of the ink cartridge 130 by causing a deformation of the sheet 10, preferably the paper discharge unit further includes a distance-keeping unit that keeps the end portion E of the sheet 10 from becoming spaced further from the nozzle part 135 due to the deformation of the sheet 10. This suppresses the tendency of ink firing from the nozzle part 135 to improperly print images due to the end portion E of the sheet 10 staying too remote from the nozzle part 135. Accordingly, the distance D between the nozzle part 135 and the sheet 10 is preferably formed in a usual interval enabling image printings to be done by ink firing from the nozzle part 135.

In order to carry out the function described above, the distance-keeping unit of the present embodiment includes a guide member 118 mounted opposite to the nozzle part 135 of the ink cartridge 130 and spaced in a certain distance D from the nozzle part 135. The guide member 118 guides the bottom face of the sheet 10 being fed during image printing under the ink cartridge while restraining the end portion E of the sheet 10 from descending more than the certain distance D when the sheet 10 is deformed by the paper discharge guide 210.

Figure 3:
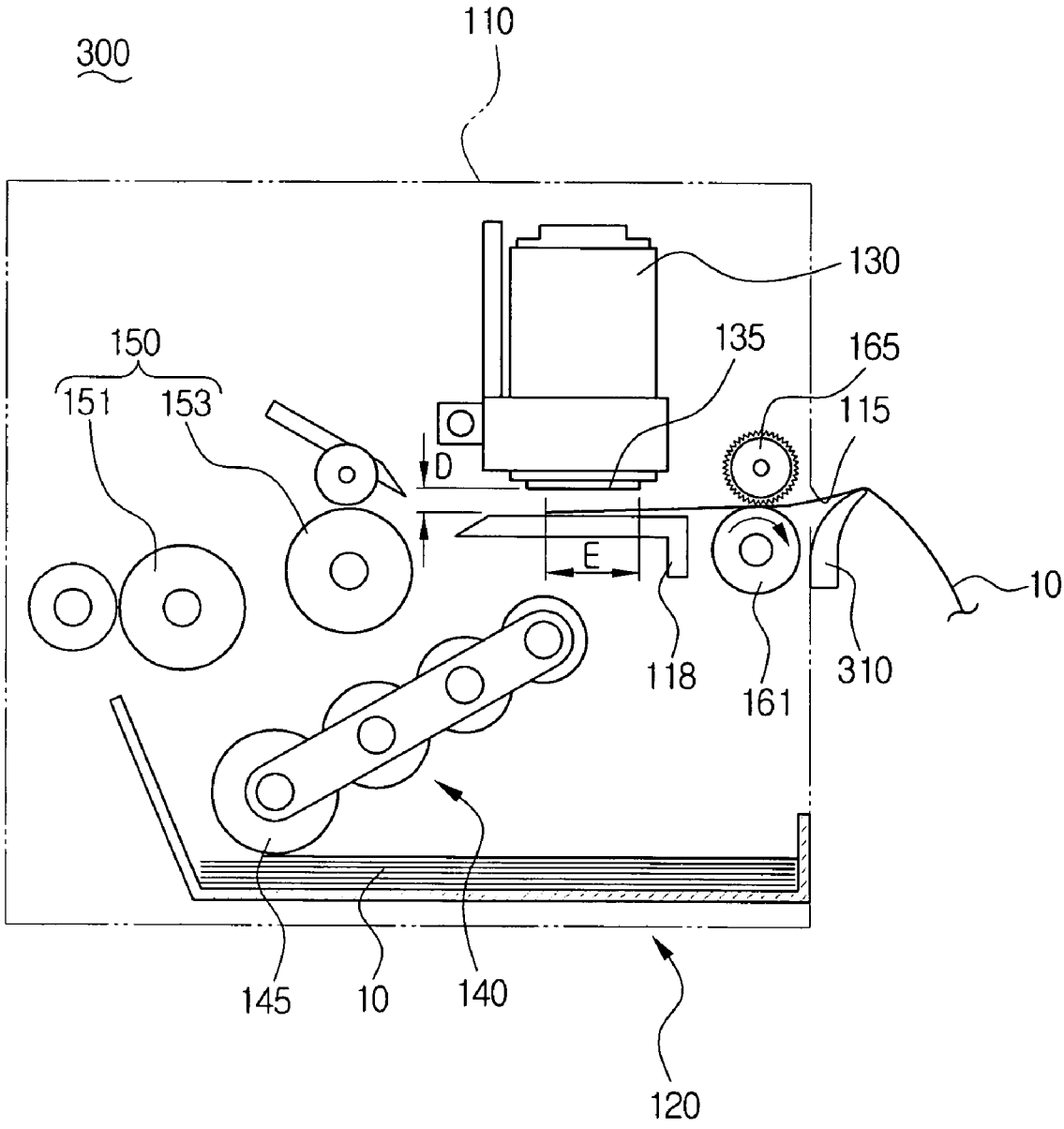
FIG. 3 is a view for schematically showing an internal structure of an inkjet printer according to a second embodiment of the present invention.

A paper discharge unit for an inkjet printer 300 according to a second embodiment of the present invention shown in FIG. 3 has the same structure except that the paper discharge rollers 161 are mounted near the paper discharge opening 115 of the printer main body 110 so that the paper discharge guide 310 is installed at a different location with respect to the paper discharge guide 210. Preferably, the paper discharge guide 310 is mounted so as to protrude by a certain length from the outer wall of the printer main body 110 under the paper discharge opening 115 so that the end portion of the paper discharge guide 310 is placed higher than the contact portion of the paper discharge rollers 161 and the idle rollers 165. Operations of the paper discharge unit for the inkjet printer 300 according to the present embodiment structured above are the same as those of the preceding first embodiment, so the detailed description on the operations will be omitted.

Figure 4:
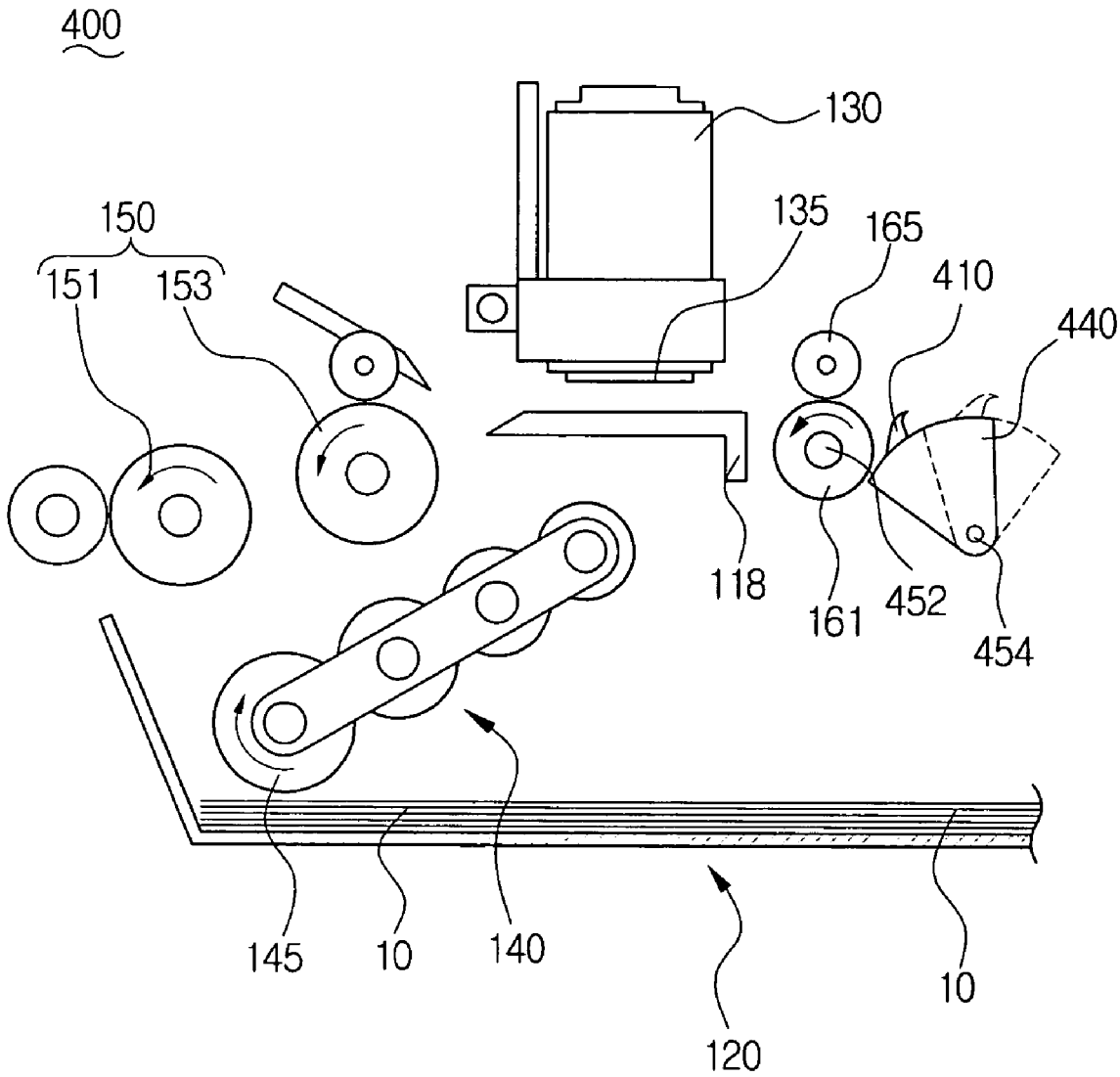
FIG. 4 is a view for schematically showing an internal structure of an inkjet printer according to a third embodiment of the present invention.
Figure 5:
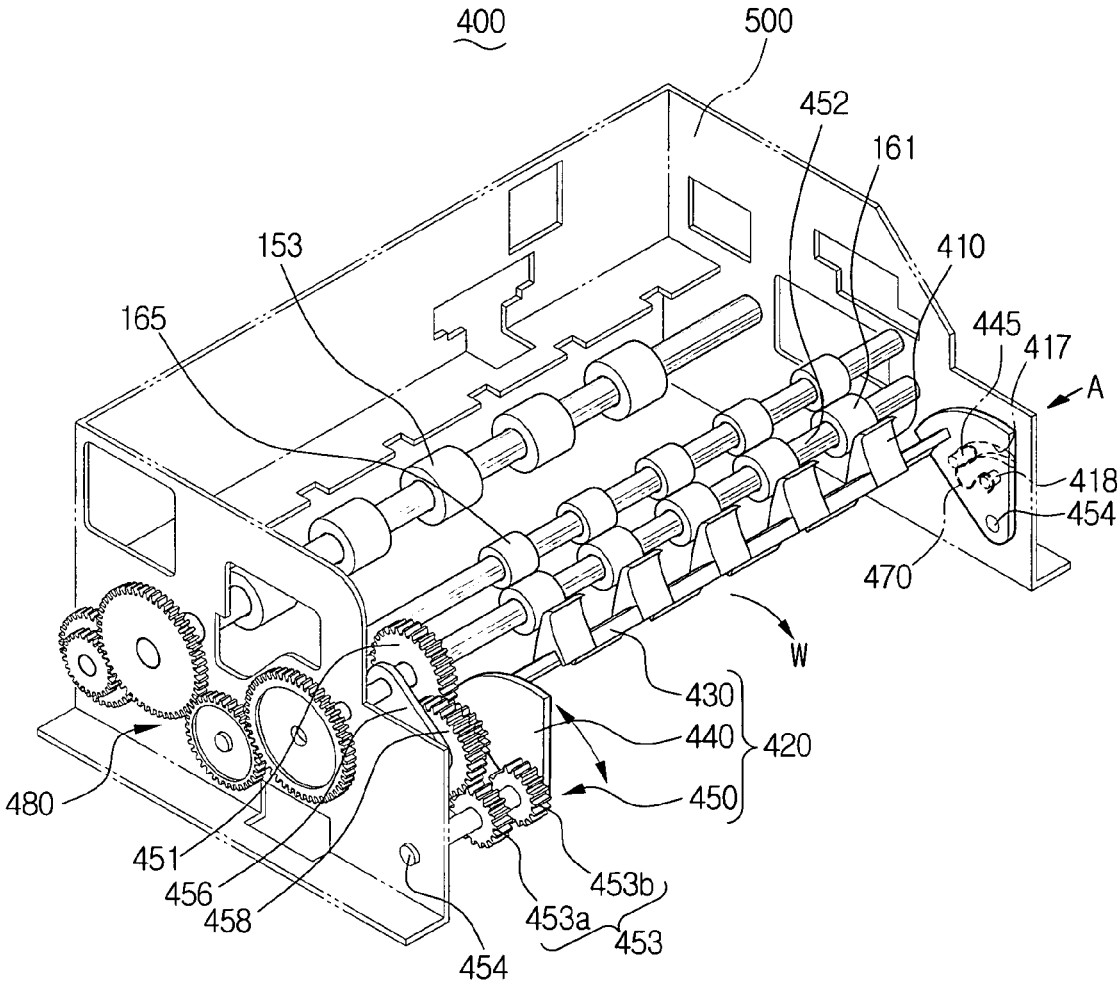
FIG. 5 is a perspective view for schematically showing the interior of the inkjet printer according to the third embodiment of the present invention.

In an inkjet printer 400 according to the third embodiment of the present invention as shown in FIG. 4 and FIG. 5, a paper discharge unit for the inkjet printer 400 according to the present embodiment has paper discharge rollers 161 and a guide unit to guide the front end of a sheet upward just after the front end is ejected from the paper discharge rollers 161. A frame 500 is provided to support driving parts inside the printer main body 110. The guide unit of the present embodiment includes paper discharge guides 410 and a driving unit 420. The paper discharge rollers 161 are structured in the same fashion as the first and second embodiments aforementioned, so the detailed description on the rollers 161 will be omitted.

The paper discharge guides 410 are mounted to be movable upward and downward at the downstream side of the paper discharge rollers 161 in a sheet-discharging direction W (Refer to FIG. 5). As in the previous first embodiment, in case that a certain paper discharge path P(refer to FIG. 2) is formed between the paper discharge rollers 161 and the paper discharge opening 115, the paper discharge guides 410 are elevatably mounted so that the upper end portions of the guides 410 can be selectively protruded on the paper discharge path P. As in the second embodiment aforementioned, in case that the paper discharge rollers 161 are mounted on the paper discharge opening 115, even though not shown, diverse variant embodiments become available in mounting the paper discharge guides, like the paper discharge guides(not shown) are mounted to be disposed outside the printer main body 110 when moving up, and so on.

Such paper discharge guides 410 ascend so that the end portions of the guides 410 are placed higher than the contact portion of the paper discharge rollers 161 and the idle rollers 165, that is, the contact portion of the paper discharge rollers 161 and a sheet, and descend so that the end portions of the guides 410 are placed equal to or lower than the contact portion of the paper discharge rollers 161 and the idle rollers 165. Therefore, when the sheet 10 is ejected from the paper discharge rollers 161 in the state that the paper discharge guides 410 are ascended, the end portions of the paper discharge guides 410 are placed higher than the paper discharge rollers 161 in contact with the bottom face of the front end of the sheet 10 so that the same function as the paper discharge guides 410 in the first embodiment aforementioned can be performed.

In the meantime, the driving unit 420 selectively causes the paper discharge guides 410 to ascend and descend in accordance with paper discharges. The driving unit 420 in the present embodiment therefore includes a support member 430, rotating members 440, and a rotating unit 450.

The support member 430 supports at least one or more paper discharge guides 410. The rotating members 440 are coupled to the support member 430 on both ends respectively, and are rotatably supported by second rotation shaft 454 on the inner walls of the frame 500. In the present embodiment, the supporting member 430, the rotating members 440, and the paper discharge guides 410 are formed in one body. Thus, the supporting member 430 rotates so the end portions of the paper discharge guides 410 may be higher and lower than the contact surfaces of the paper discharge rollers 161 and the idle rollers 165 while the rotating members 440 rotate about the second rotation shaft members 454.

Figure 6:
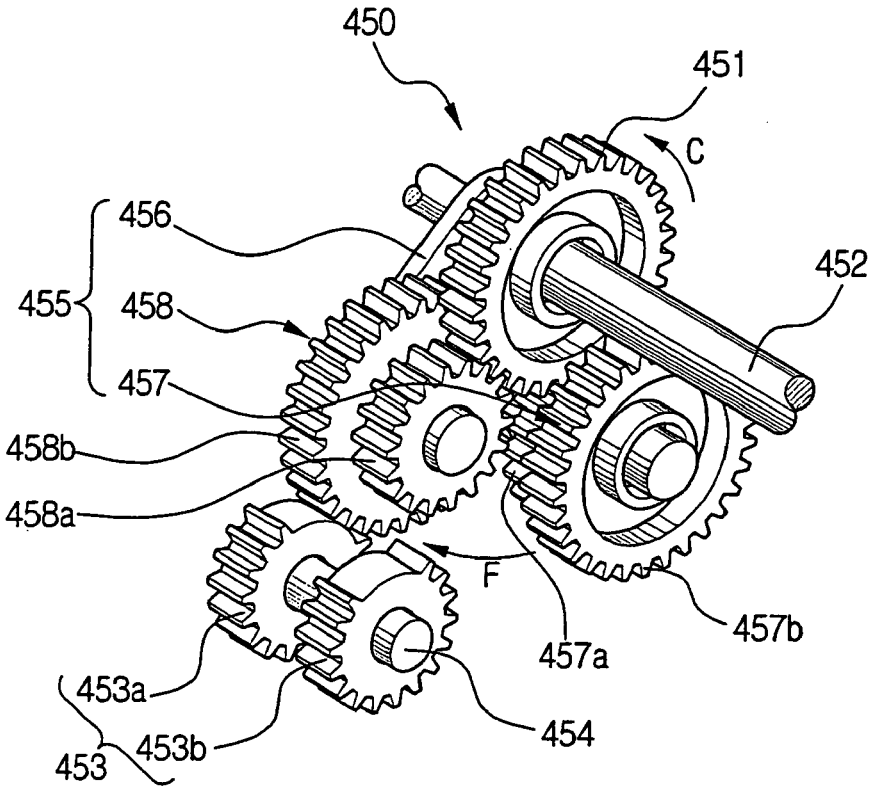
FIG. 6 is a perspective view for schematically showing a portion of driving unit of FIG. 5.
Figure 7:
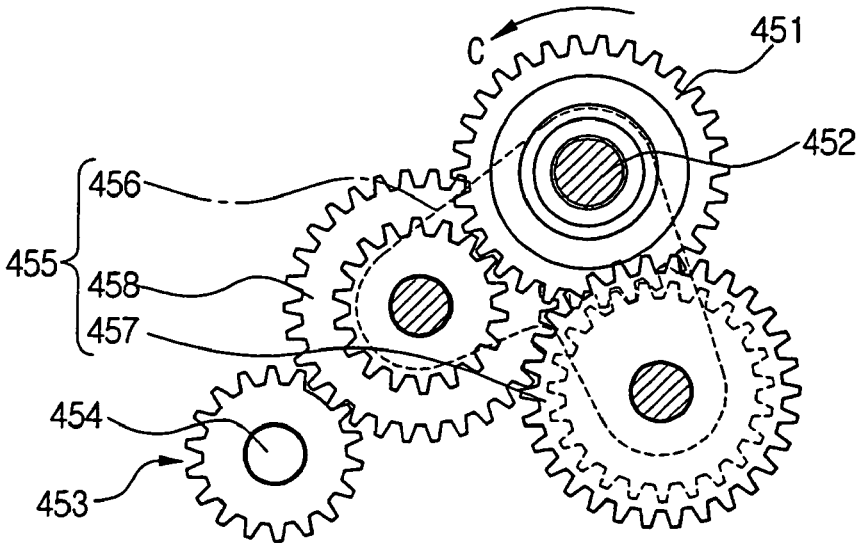
FIG. 7 is a side view for showing operation states of a swing gear assembly of FIG. 6.

In FIG. 6 and FIG. 7, the rotating unit 450 rotating the rotating members 440 includes a first gear 451 rotatably mounted on one side of the frame 500 by a first rotation shaft member 452 and receiving a driving force of a certain driving unit for rotations, and a second gear 453 mounted on the second rotation shaft member 454 rotatably connecting any of the pair of rotating members 440 to the printer main body 110 and formed in one body with the rotating members 440. The first gear 451 in the present embodiment is connected through the second feeding rollers 153 (refer to FIG. 5) and a certain gear train 480 (refer to FIG. 5), and the plural paper discharge rollers 161 are mounted on the first rotation shaft member 452. The second feeding rollers 153 rotate in association with the rotations of the paper discharge rollers 161. Meanwhile, the second gears 453 receive a driving force from the first gear 451 to rotate, and such first and second gears 451 and 453 can be connected in diverse manners such as directly or indirectly meshing the gears. The second gears 453 in the present embodiment include plural second gears 453*a* and 453*b* mounted side by side on the second rotation shaft members 454, which will be described later. In case that a connection manner of the first and second gears 451 and 453 is changed, it is natural that the construction of the rotating members 440 and the support member 430 is changed to ascend and descend the paper discharge guides 410 corresponding to rotation directions of the paper discharge rollers 161.

As described above, in the present embodiment, a swing gear assembly 455 including a pivot member 456 and third and fourth gears 457 and 458 is employed as a power transmission unit to indirectly connect the first gear 451 and the second gears 453*a* and 453*b*. The pivot member 456 is rotatably mounted to the first rotation shaft member 452 supported by the first gear 451. Further, the third and fourth gears 457 and 458 are spaced from each other and rotatably mounted to mesh with the first gear 451 respectively on one side of the pivot member 456. With such a structure, upon rotations of the first gear 451, only one of the third and fourth gears 457 and 458 is selectively meshed with the second gears 453*a* and 453*b* by the pivot member 456 rotating in the same direction as the rotation direction of the first gear 451 about the first rotation shaft member 452. That is, when the paper discharge rollers 161 rotate in a direction of ejecting sheets, the pivot member 456 rotates in the same direction as a rotation direction C of the first gear 451, and, accordingly, the third gear 457 is meshed with the second gear 453*a* to rotate so that the rotating members 440 can rotate in a direction that the paper discharge guides 410 ascend. In a state that the sheet 10 is completely ejected, the paper discharge rollers 161 rotate reverse. In this case, the pivot member 456 rotates in the opposite direction to the above rotation direction C so that the fourth gear 458 and the second gear 453*b* are meshed and rotate together. Accordingly, the rotating members 440 rotate in a direction that the paper discharge guides 410 descend. Such reverse rotations of the paper discharge rollers 161 are carried out when the pickup roller 145 is driven to pick up the sheet 10, which is generally implemented in the case that the paper discharge rollers 161 eject the sheet 10.

When the power of the first gear 451 is transferred to the second gears 453*a* and 453*b* by the power transmission unit structured above, the third and fourth gears 457 and 458 are formed in a two-stage gear formed in a one-on-one manner with plural gears on the respective outer circumferences thereof in order to effectively control rotation speed and angle of the second gears 453*a* and 453*b*. The third and fourth gears 457 and 458 according to the present invention each have first gears 457*a* and 458*a* meshed with the first gear 451, and second gears 457*b* and 458*b* meshed with the second gear 453*a* and 453*b* upon rotations of the pivot member 456. Further, the second gears 453*a* and 453*b* are constructed with sector gears having a partial no-load rotation section in order to restrain the rotating members 440 to continuously rotate due to the continuous rotations of the paper discharge rollers 161, and preferably mounted in a pair in series on the second rotation shaft members 454 in order to effectively receive power from the respective third and fourth gears 457 and 458.

Figure 8:
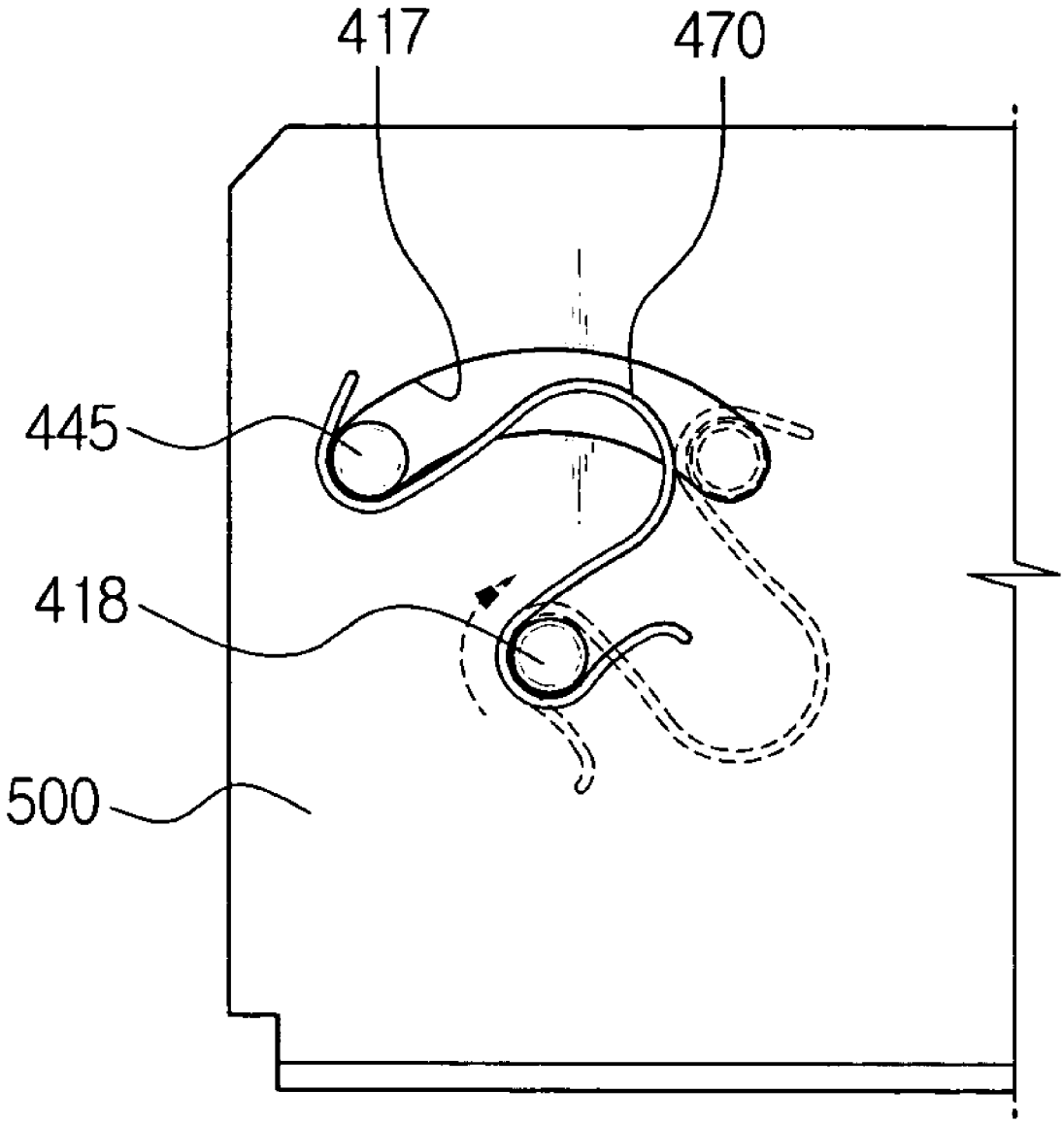
FIG. 8 is a side view for showing an internal structure of the inkjet printer of FIG. 5 viewed at A.

As shown in FIG. 8, the above limitation of rotation ranges of the rotating members 440 can be more precisely implemented by a guide slit 417 formed in an arc shape in an inner wall of the frame 500 and a guide protrusion 445 formed on the outer side of the rotating member 440 to be guided by the guide slit 417 upon rotations of the rotating members 440. Even though not shown, the functions described above can be carried out alike when the guide protrusion 445 is directly protruded from one side of the support member 430 to be inserted in the guide slit 417, in the case that the rotating members 440 are coupled on only one side of the support member 430.

The driving unit 420 of the present embodiment of the invention further includes an elastic member 470 so the paper discharge guides 410 are able to elastically maintain their positions when the guides 410 are ascended or descended. The elastic member 470 elastically presses the guide protrusion 445 when the guide protrusion 445 is moved to one of both ends of the guide slit 417 to restrain the guide protrusion 445 from moving to the other end of the guide slit 417.

In the present embodiment, a one side-opened annular toggle spring is used as the elastic member 470 with both ends being rotatably coupled with the guide protrusion 445 and a support protrusion 418. In case that the guide protrusion 445 is positioned at one end of the guide slit 417, the guide protrusion 445 is elastically pressed to the end of the guide slit 417 by the elastic member 470. Further, as the rotating members 440 rotate by the rotations of the second gears 453*a* and 453*b* so that the guide protrusion 445 moves to the central portion of the guide slit 417, the elastic member 470 is compressed to elastically press the guide protrusion 445 to its original position. However, if the guide protrusion 445 moves beyond the central position of the guide slit 417, the elastic member 470 carries out relative rotations with respect to the guide protrusion 445 and the frame 500 respectively, to elastically press the guide protrusion 445 to the other side of the guide slit 417. The rotating members 440 can rotate more precisely by such second gears 453*a* and 453*b*, guide protrusion 445, guide slit 417, and elastic member 470.

Hereinafter, operations of the paper discharge unit for an inkjet printer according to the present embodiment will be described in order with reference to FIG. 9 and FIG. 10.

Figure 9:
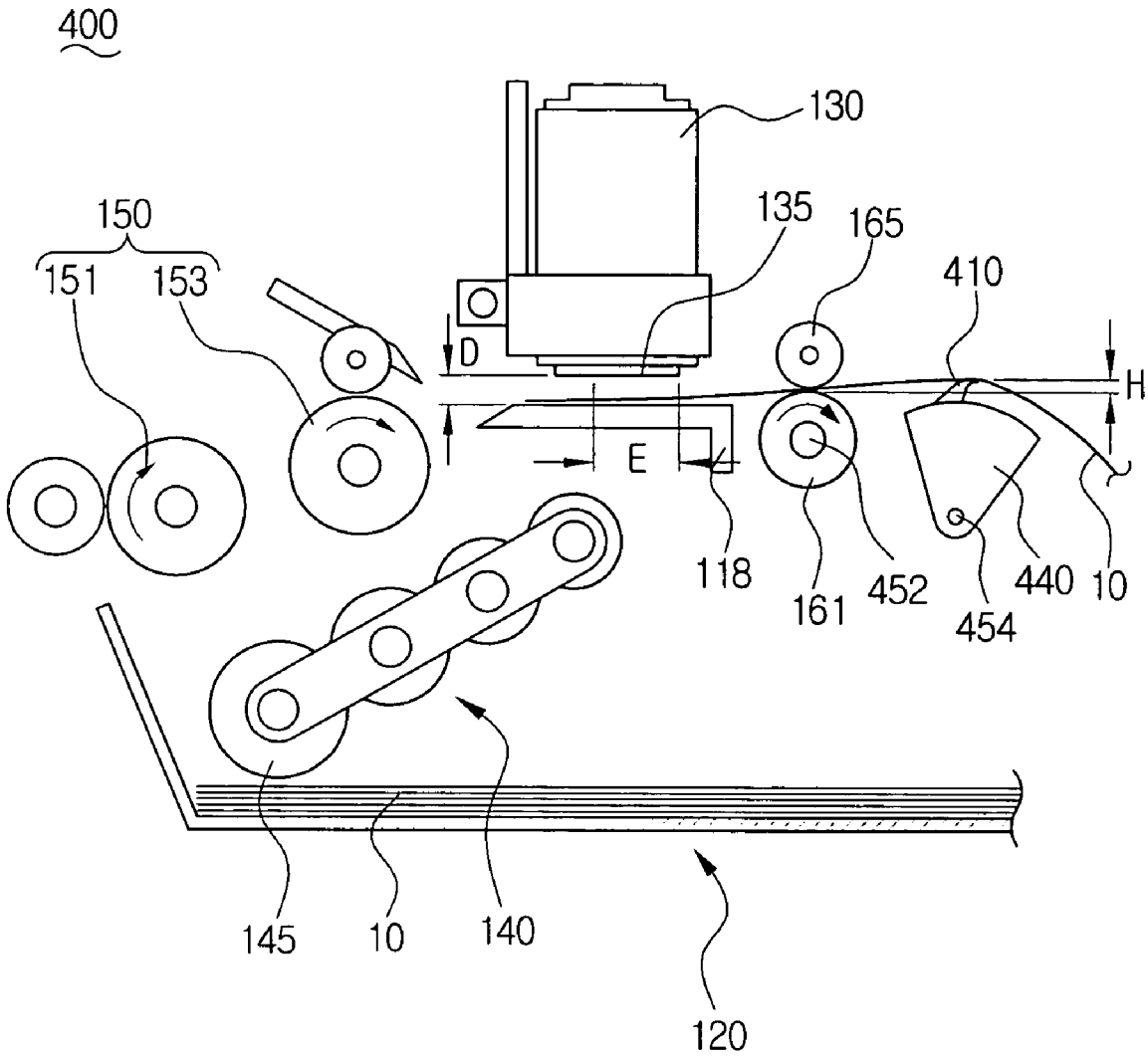
FIGS. 9 and 10 are views for showing in order internal structures of the inkjet printer based on operation states according to the third embodiment of the present invention.

First, in FIG. 9, as the paper discharge rollers 161 rotate with discharge of the sheet 10, the rotating members 440 rotate by the driving of the gears 451, 453*a*, 453*b*, 457, and 458 (refer to FIG. 6) described above so that the paper discharge guides 410 ascend. At this time, the upper end portions of the paper discharge guides 410 are placed higher than the contact portion of the paper discharge rollers 161 and the idle rollers 165, that is, the contact portion of the sheet 10 and the paper discharge rollers 161, and, as the sheet 10 is fed, the sheet 10 is deformed so that the front end portion of the printing face of the sheet 10 is bent upward. According to this, the sheet 10 is ejected in a state that the rear end portion, particularly, the end portion E of the sheet 10 descends to be spaced in a certain distance D from the nozzle part 135. At this time, the end portion E of the sheet 10 descends only until it is spaced at the certain distance D from the nozzle part 135 by the guide member 118 as described in the previous first embodiment, and, since the end portion E of the sheet 10 can maintain the certain distance D from the nozzle part 135, image printing can be possible up to the end portion E of the sheet 10.

Figure 10:
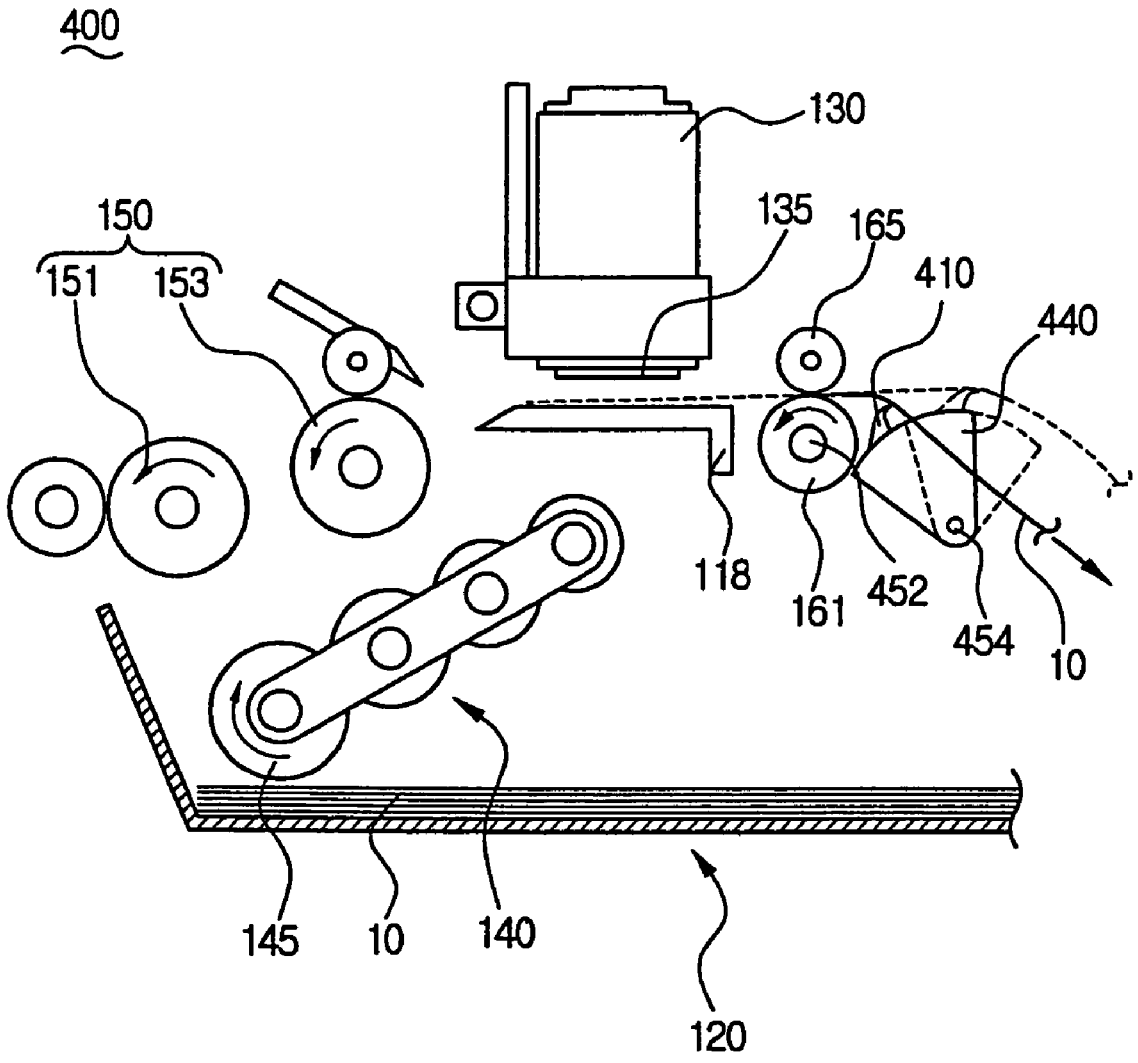

As shown in FIG. 10, if the sheet 10 is completely ejected so that the end portion of the sheet 10 is spaced from the paper discharge rollers 161, the paper discharge rollers 161 rotate in the direction opposite to when the sheet 10 is ejected. Accordingly, the rotating members 440 rotate in a direction that the paper discharge guides 410 descend, and the sheet 10 in a state that the end portion thereof is supported by the paper discharge guides 410 is completely separated from the paper discharge rollers 161 by the weight of the sheet 10.

The present invention described as above can guide the bent sheet 10 since the paper discharge guides 210, 310, and 410 protrude in a certain height downstream of the paper discharge rollers 161 in the direction of discharging the sheet 10. As such, the deformation of the sheet 10 enables the sheet 10 to be fed in a state that the end portion E of the sheet 10 is spaced in the certain distance D from the nozzle part 135 of the ink cartridge 130.

Accordingly, image printing can be implemented up to the end portion E of the sheet 10, bringing out an effect capable of enhancing a printing efficiency of an inkjet printer.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A paper discharge unit used with an inkjet printer which ejects a sheet of paper, on which image printing is completed by an ink cartridge having a nozzle part, out of a printer main body including an internal wall comprising a slit, comprising:

a paper discharge roller rotatably mounted in the printer main body, to feed the sheet out of the printer main body;

a paper discharge guide disposed between the paper discharge roller and a paper discharge opening which is formed in one side of the printer main body; and a driving unit to move the paper discharge guide to guide a front end of the sheet upward just after the front end is ejected from the paper discharge roller so as to prevent a rear end portion of the sheet from being lifted toward the nozzle part of the ink cartridge, the driving unit comprising a protrusion received by the slit which thereby guides the protrusion, a range of movement of the driving unit being limited by the protrusion and the slit.

2. The paper discharge unit as claimed in claim 1, wherein the paper discharge guide has an upper end portion which is placed higher than contact surfaces of the paper discharge roller and the sheet.

3. A paper discharge unit used with an inkjet printer which ejects a sheet, on which image printing is completed by an ink cartridge having a nozzle part, out of a printer main body including an internal wall comprising a slit, comprising:

a paper discharge roller rotatably mounted in the printer main body, to feed the sheet out of the printer main body;

a paper discharge guide pivotably mounted between the paper discharge roller and a paper discharge opening which is formed in one side of the printer main body, to guide the bottom face of the sheet ejected from the paper discharge roller; and a driving unit to pivot the paper discharge guide in order for an upper end portion of the paper discharge guide to be disposed higher than a contact surface between the paper discharge roller and the sheet as the sheet is discharged from the paper discharge roller, the driving unit comprising a protrusion received by the slit which thereby guides the protrusion, a range of movement of the driving unit being limited by the protrusion and the slit.

4. The paper discharge unit as claimed in claim 3, wherein the driving unit includes:

a support member supporting the paper discharge guide, the protrusion protruding therefrom;

rotating members rotatably mounted on the printer main body, and supporting the support member; and a rotating unit rotating the rotating members so the paper discharge guide ascends and descends in association with sheet feeding.

5. A paper discharge unit used with an inkjet printer which ejects a sheet, on which image printing is completed by an ink cartridge having a nozzle part, out of a printer main body, comprising:

a paper discharge roller rotatably mounted in the printer main body, to feed the sheet out of the printer main body;

a paper discharge guide pivotably mounted downstream of the paper discharge roller in a direction the sheet is fed, to guide the bottom face of the sheet ejected from the paper discharge roller; and a driving unit to pivot the paper discharge guide in order for an upper end portion of the paper discharge guide to be disposed higher than a contact surface between the paper discharge roller and the sheet as the sheet is discharged from the paper discharge roller, wherein the driving unit includes:

a support member supporting the paper discharge guide;

rotating members rotatably mounted on the printer main body, and supporting the support member; and a rotating unit rotating the rotating members so the paper discharge guide ascends and descends in association with sheet feeding, and the rotating unit includes:

a first gear rotatably supported by a first rotation shaft on one interior side of the printer main body, and receiving a driving force to rotate; and second gears mounted on a second rotation shaft to rotatably support the rotating members on one interior side of the printer main body, and to rotate the rotating members in association with rotations of the first gear.

6. The paper discharge unit as claimed in claim 5, wherein the second gears directly mesh with the first gear.

7. The paper discharge unit as claimed in claim 6, wherein the first gear alternately rotates forward and reverse corresponding to positions of the sheet as the sheet is fed.

8. The paper discharge unit as claimed in claim 7, wherein the second gears are sector gears rotating by a certain rotation angle in association with the rotations of the first gear.

9. The paper discharge unit as claimed in claim 8, wherein the second gears are formed in one body with the rotating members.

10. The paper discharge unit as claimed in claim 9, wherein the paper discharge roller is mounted on the first rotation shaft to rotate in association with the rotations of the first gear.

11. The paper discharge unit as claimed in claim 5, further comprising a power transmission unit to transmit a driving force from the first gear to the second gears.

12. The paper discharge unit as claimed in claim 11, wherein the first gear alternately rotates forward and reverse corresponding to positions of the sheet as the sheet is fed.

13. The paper discharge unit as claimed in claim 12, wherein the power transmission unit is a swing gear assembly interactably connecting the first gear and the second gears.

14. The paper discharge unit as claimed in claim 13, wherein the swing gear assembly includes:

a pivot member rotatably mounted on the first rotation shaft of the first gear; and third and fourth gears spaced from each other and rotatably mounted on the pivot member, and meshed with the first gear respectively, the pivot member rotating by the third and fourth gears meshed with the first gear as the first gear rotates, and the second gears selectively meshed with one of the third and fourth gears corresponding to rotations of the pivot member.

15. The paper discharge unit as claimed in claim 14, wherein the second gears are sector gears rotating by a certain rotation angle in association with rotations of the first gear.

16. The paper discharge unit as claimed in claim 15, wherein the third and fourth gears are multi-stepped gears each having a first gear part meshed with the first gear and a second gear part selectively meshed with the second gear upon the rotations of the pivot member.

17. The paper discharge unit as claimed in claim 16, wherein the second gears are mounted side by side in plural on a second rotation shaft member, and each of the second gears is selectively meshed with the third and fourth gears respectively as the pivot member rotates.

18. The paper discharge unit as claimed in claim 17, wherein the second gears are formed in one body with the rotating members.

19. The paper discharge unit as claimed in claim 17, wherein the second gears, support member, rotating members, and paper discharge guides are formed in one body.

20. The paper discharge unit as claimed in claim 5, wherein the first gear is connected through sheet feeding rollers rotatably mounted upstream of the ink cartridge in the direction the sheet is fed, supplying the sheet to the sheet discharge rollers and a certain gear train.

21. A paper discharge unit used with an inkjet printer which ejects a sheet, on which image printing is completed by an ink cartridge having a nozzle part, out of a printer main body, comprising:

a paper discharge roller rotatably mounted in the printer main body, to feed the sheet out of the printer main body;

a paper discharge guide pivotably mounted downstream of the paper discharge roller in a direction the sheet is fed, to guide the bottom face of the sheet ejected from the paper discharge roller; and a driving unit to pivot the paper discharge guide in order for an upper end portion of the paper discharge guide to be disposed higher than a contact surface between the paper discharge roller and the sheet as the sheet is discharged from the paper discharge roller, wherein the driving unit includes:

a support member supporting the paper discharge guide;

rotating members rotatably mounted on the printer main body, and supporting the support member;

a rotating unit rotating the rotating members so the paper discharge guide ascends and descends in association with sheet feeding;

a guide protrusion which protrudes on one side of the support member opposite to an internal wall of the printer main body; and a guide slit formed in the internal wall of the printer main body to guide rotations of the guide protrusion, a rotation range of the support member being limited by the guide protrusion and the guide slit.

22. The paper discharge unit as claimed in claim 21, wherein the driving unit further includes an elastic member that elastically presses the guide protrusion moved to either of both ends of the guide slit, to thereby restrain the guide protrusion from moving to the other end of the guide slit.

23. The paper discharge unit as claimed in claim 22, wherein the elastic member is a toggle spring both ends of which are connected to the guide protrusion of the rotating member and the printer main body, respectively.

24. The paper discharge unit as claimed in claim 23, wherein the toggle spring is formed in a one end-opened annular shape, and both ends of which are rotatably connected to the guide protrusion and the printer main body, respectively.

* * * * *

UNITED STATES PATENT AND TRADEMARK OFFICE

CERTIFICATE OF CORRECTION

PATENT NO. : 7,083,346 B2
APPLICATION NO. : 10/695352
DATED : August 1, 2006
INVENTOR(S) : Youn-gun Jung et al.

It is certified that error appears in the above-identified patent and that said Letters Patent is hereby corrected as shown below:

Column 11, Line 23, change “ink cartridge” to --nozzle part--.

Signed and Sealed this

Twenty-third Day of January, 2007

JON W. DUDAS
*Director of the United States Patent and Trademark Office*